United States Patent [19]

Schubart

[11] Patent Number: 4,922,824

[45] Date of Patent: May 8, 1990

[54] STAND DEVICE FOR A MINE

[75] Inventor: Rudolf Schubart, Ruckersdorf, Fed. Rep. of Germany

[73] Assignee: Diehl GmbH & Co., Nuremberg, Fed. Rep. of Germany

[21] Appl. No.: 343,022

[22] Filed: Apr. 25, 1989

[30] Foreign Application Priority Data

May 20, 1988 [DE] Fed. Rep. of Germany ..... 3817265

[51] Int. Cl.[5] ..... F42B 23/18

[52] U.S. Cl. ..... 102/387; 102/400; 102/425

[58] Field of Search ..... 102/386, 387, 388, 382, 102/393, 400, 404, 405, 425, 306

[56] References Cited

U.S. PATENT DOCUMENTS

| | | | |
|---|---|---|---|
| 1,442,345 | 1/1923 | Kee | 102/387 |
| 3,859,598 | 1/1975 | McElwain et al. | 102/400 |
| 3,875,862 | 4/1975 | Fischer et al. | 102/425 |
| 4,175,491 | 11/1979 | Thomanek | 102/404 |
| 4,538,519 | 9/1985 | Witt et al. | 102/386 |

FOREIGN PATENT DOCUMENTS

| | | | |
|---|---|---|---|
| 0069914 | 1/1983 | European Pat. Off. | 102/425 |
| 0285183 | 10/1988 | European Pat. Off. | 102/387 |
| 3127071 | 1/1983 | Fed. Rep. of Germany | 102/386 |
| 3344601 | 6/1985 | Fed. Rep. of Germany | 102/425 |
| 294456 | 7/1928 | United Kingdom . | |
| 469381 | 7/1937 | United Kingdom . | |
| 1394425 | 5/1975 | United Kingdom . | |
| 1412140 | 10/1975 | United Kingdom . | |
| 2174482 | 11/1986 | United Kingdom . | |

*Primary Examiner*—David H. Brown

*Attorney, Agent, or Firm*—Scully, Scott, Murphy & Presser

[57] ABSTRACT

A stand device or emplacement for a mine, especially for an air-deployable mine which is equipped with a search head, and which includes supporting legs articulated to the housing of the mine. The stand device for the mine has the supporting legs articulated to a cardanic or gimbal suspension in the upper region of the mine housing, and incorporate telescopable legs wherein, in dependence upon the setting of the mine housing on the ground, the spread apart support legs render these releasable for the outward extension and raising of the mine housing above the ground.

7 Claims, 1 Drawing Sheet

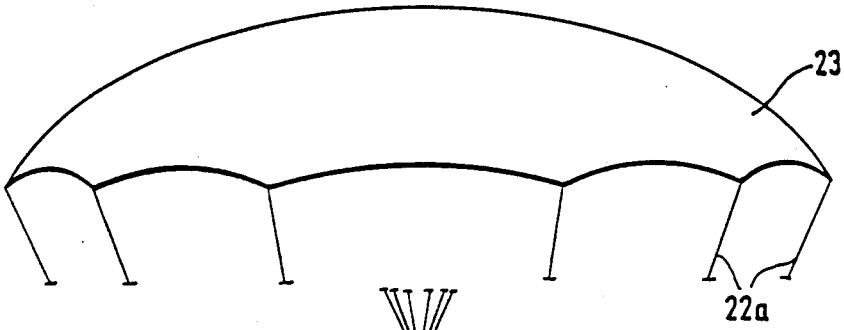
Fig. 1
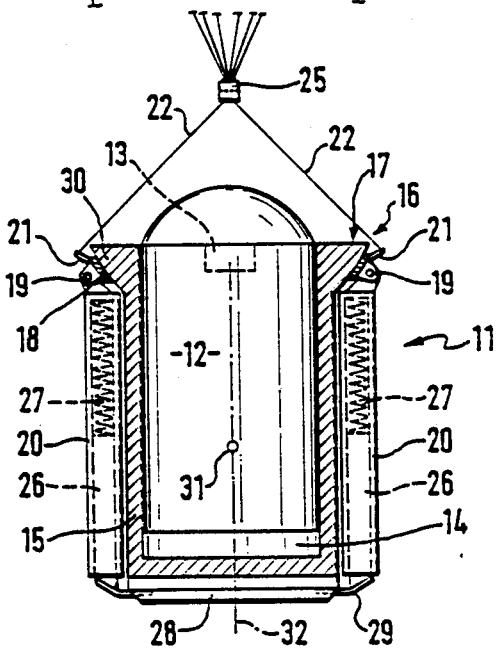
Fig. 2
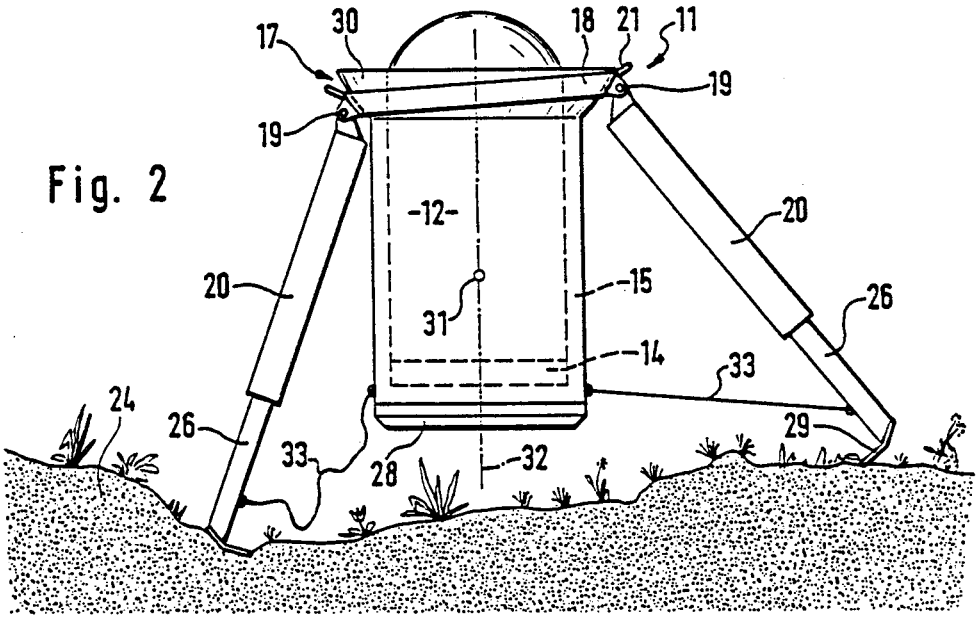

STAND DEVICE FOR A MINE

BACKGROUND OF THE INVENTION

1. Field of the Invention

The present invention relates to a stand device or emplacement for a mine, especially for an air-deployable mine which is equipped with a search head, and which includes supporting legs articulated to the housing of the mine.

2. Discussion of the Prior Art

In general, air-deployable mines of the type which is under consideration herein has become known from the disclosure of British Patent No. 1,394,425, assigned to the common assignee of this application. With respect to this mine, there is preferably contemplated a lurking remote-action mine which is equipped with an active component including a seeker head, as is described in Laid-Open British Patent Appln. No. 2,174,782, also assigned to the present assignee with reference to the submunition equipped with search heads, of the type identified as HABICHT or SADARM. A mine of that type is deployed through the intermediary of a carrier over the intended blockaded region, and at that location set down softly with the use of a parachute. A proximity sensor activates a starting device, such as a small propulsion mechanism, in order to be able to deploy the active component of the mine which is equipped with the warhead, search head-sensor elements and the descent-braking parachute, into the airspace above the blockaded region, when a target object which is to be attacked approaches, on the ground or closely above the ground, to the position of the mine. Subsequently, there is carried out an attack against the target object by a projectile-forming charge when the search head-sensor determines the passing over of the target object through the axis of effectiveness of the active member.

Whereas for the technology of the search head-active member there has already been obtained the proof of operational dependability, problems can be encountered with respect to the utilization of a mine incorporating such an active member, in that the starting or launch housing pursuant to randomly encountered conditions on the ground, and thereby as a rule, may not be vertically oriented; with the consequence, that the approach of the target object leads to the starting of the active member into a sideways offset airspace, from which this target object can no longer be attacked with a sufficient expectation of success.

SUMMARY OF THE INVENTION

In recognition of these conditions, it is accordingly an object of the present invention to so equip a mine of the type under consideration herein, so as to ensure the proper functioning and action thereof, subsequent to its activation in response to the approach of a target object, in the immediate surroundings of the mine location and thereby the momentary position of the target object which is to be attacked, although the action should only be commenced from an elevated position.

The foregoing object is inventively achieved in that the stand device for the mine has the supporting legs articulated to a cardanic or gimbal suspension in the upper region of the mine housing, and incorporate telescopable legs wherein, in dependence upon the setting of the mine housing on the ground, the spread apart support legs render these releasable for the outward extension and raising of the mine housing above the ground.

Pursuant to the foregoing, and practically independently of the local conditions of the ground onto which the mine is deposited into a waiting or lurking position, there is constantly afforded a vertical suspension of its launch housing from the framework which consists of the expanding or spreading support legs and the suspension. Resulting therefrom is a vertical launch of the active member from the housing into the airspace directly above the approaching target object, so that there is obtained with a high degree of probability a rapid determination by means of the search head of the target object which is to be attacked.

Obtained through the cardanic or gimbal suspension is a particularly simple and stable construction, when a spherical washer which is fastened to the housing has a concave spherical washer extending therebeneath as the cardanic or gimbal inner frame, and to which the spreading legs are hingedly attached. These legs are then released during setting on the ground for spreading apart pursuant to a path of movement which is predetermined by the spherical surface; in essence, the maximum spread or expanse is determined by the extent as to how far from the distance from the pole the spherical washer is intersected. Simultaneously there is cleared the outward displacement of stand leg extensions (telescopic legs), in order to have the mine raise its suspension into the open above the ground.

BRIEF DESCRIPTION OF THE DRAWINGS

Additional alternatives and modifications, as well as further features and advantages of the invention can now be readily ascertained from the following detailed description of an exemplary embodiment of the stand device for a mine, taken in conjunction with the accompanying drawings; in which:

FIG. 1 illustrates a longitudinal sectional view through a mine which is equipped with a search head, during its airborne deployment suspended from a setting-down parachute; and FIG. 2 illustrates the mine pursuant to FIG. 1, set down and positioned on the ground subsequent to the discarding of the parachute.

DETAILED DESCRIPTION

The air deployable mine 11 is equipped with a search head, and as illustrated in the drawing, essentially consists of an active component 12 with a search head-sensor installation 13 and a launching device 14, which are arranged within a housing 15 which is concurrently designed as a stationarily remaining recoil component or expellant. The housing is supported at its upper region 16 by a cardanic or gimbal suspension 17, on the outer frame 18 of which there are provided hinge joints 19 for the support legs 20 which are spreadable from a retracted deploying position (FIG. 1) into the standing support position (FIG. 2). Moreover, holders 21 are located on the outer frame 18 for shroud lines 22 connected to a conventional latching closure 25, with shroud lines 22a leading to a setting-down parachute 23 which, upon the depositing of the mine 11 on the ground 24 (FIG. 2), will be separated from the mine 11 due to the unloading-unlatching of latch closure 25, upon loss of tension in shroud lines 22 and 22a. Shroud lines 22 remain attached to the mine, while shroud lines 22a and parachute 23 and can then drift away so as not to cover the mine on the ground 24; in effect, to prevent any subsequent interferences with the functioning of the mine.

The support legs 20 are extendable through telescopic legs 26 which, for example, are automatically extendable through compression spring-energy accumulators 27 when the support legs 20 are released from their axially-parallel deploying position (FIG. 1). This release is effected by means of a depositing-triggering device 28, which is preferably formed as a non-elastic damping arrangement in the type of a deforming cushion below the bottom of the mine 11, which is movable in a longitudinal direction towards the mine housing. Upon deformation, due to being deposited on the ground 24, triggering device 28 is moved to release restraining claws 29, which are latched to triggering device 28 in a conventional manner such as friction, detents, etc. Claws 29 can be concurrently designed to provide support surfaces against the sinking in of the extended telescopic legs 26 into the ground 24 (shown in FIG. 2).

The spreading apart of the support legs 20 is implemented through the application of a turning moment about the applicable hinge joint 19 up to a stop position, which may be constructively provided on the hinge joint 19 or, preferably can be carried out through a fettering restraint 33. For the application of the turning moment, conventional means such as elbow springs or hydraulic arms (not shown) can be utilized between each support leg 20 and the mine housing 15 to gently push the legs 20 away from housing 15

When the mine 11 is seated on the ground 24 with its tail end leading, and as a consequence, by means of the triggering device 28, has initiated the outward extension of their elongatable telescopic legs 26, the support thereof against the ground 24 (FIG. 2) causes a lifting up of the mine 11 above the ground 24 and a swinging action to move the longitudinal axis 32 into the vertical (FIG. 2) extending through the low-positioned center of gravity 31 through the pivoting of the gimbal or cardanic frames 18/30 relative to each other pursuant to the measure of the support geometry against the ground 24 (in the drawing, for purposes of simplification, there are illustrated only two oppositely located support legs 20; however, in practice, at least three support legs 20 are arranged uniformly distributed about the mine housing 15).

Inasmuch as the mine 11 (FIG. 2) is then vertically oriented, and since this orientation is quite stable due to the center of gravity 31 which is located deeply below the suspension 17, there is assured a vertical take-off of the active member 12 upon the triggering of the launching device 14 for effecting the firing out of the housing 15; in effect, the activation of the search head mechanism directly above the close surroundings about the position of this mine 11, in which the approach of a suspected target object will lead to the activation of the launching device 14.

What is claimed is:

1. A stand device for a mine, especially for an air-deployable mine having a search head and a housing, said device comprising a cardanic suspension located about an upper region of said housing which includes a spherical washer fastened to the mine housing so as to form an inner frame, said washer being pivotably supported in a spherical cup-shaped outer frame;

support legs articulated to said housing at said outer frame of said cardanic suspension in a hinged arrangement, said support legs each including at least an inner and outer member in telescopic arrangement, said inner member being telescopically extendable from said outer member through a spring means positioned within said outer member, said legs being hingedly movable from a first position adjacent and parallel to said housing to a second position at an angle from said housing; and an actuating means positioned at a bottom portion of said housing responsive to contact with the ground, said actuating means being in cooperation with said support legs;

wherein upon contact with the ground said actuating means releases each of said support legs from said first position to said second position, said spring means extending said telescopic inner member of each of said support legs to elevate said housing above said ground.

2. A stand device as claimed in claim 1, wherein said actuating means is movable in a longitudinal direction towards said housing and is located below the bottom of the mine housing, said actuating means contacting the ground to release the support legs which are retracted in parallel with the longitudinal axis of the mine in the air-borne deploying position with said telescopic inner member being retracted therein.

3. A stand device as claimed in claim 1, wherein the housing is equipped with an active member of the mine which comprises an explosive mass having a center of gravity located extensively below said cardanic suspension.

4. A stand device as claimed in claim 1, wherein a turning moment is present about the respective hinge joint of each said support leg to the frame for effectuating the spreading apart of the support legs from said first position to said second position upon release by the actuating means.

5. A stand device as claimed in claim 1, wherein the support legs are supported along the outside of the inner frame for movement along an outward swinging contour, which frame supports the support legs against the mine housing which is equipped with the active member.

6. A stand device as claimed in claim 1, wherein said actuating means cooperate with said support legs by means of friction.

7. A stand device as claimed in claim 1, wherein said cardanic suspension allows for the longitudinal axis of said housing to be aligned with a vertical plane after said telescopic legs elevate the housing above the ground.

* * * * *

UNITED STATES PATENT AND TRADEMARK OFFICE

CERTIFICATE OF CORRECTION

PATENT NO. : 4,922,824

DATED : May 8, 1990

INVENTOR(S) : Rudolf Schubart

It is certified that error appears in the above-identified patent and that said Letters Patent is hereby corrected as shown below:

Column 3, line 35: "the outward extension" should read as --the outward pivoting of the support legs 20 and the outward extension--

Signed and Sealed this

Eleventh Day of June, 1991

*Attest:*

HARRY F. MANBECK, JR.

*Attesting Officer*

*Commissioner of Patents and Trademarks*